United States Patent [19]

Cappel et al.

[11] Patent Number: 4,690,054

[45] Date of Patent: Sep. 1, 1987

[54] SHEET FEED DRUM FOR ROTARY PRESSES

[75] Inventors: Bert Cappel, Muhlheim; Karl L. Knapp, Obertshausen; Adolf Jung, Muhlheim, all of Fed. Rep. of Germany

[73] Assignee: M.A.N.-Roland Druckmaschinen Aktiengesellschaft, Fed. Rep. of Germany

[21] Appl. No.: 836,007

[22] Filed: Mar. 4, 1986

[30] Foreign Application Priority Data

Mar. 6, 1985 [DE] Fed. Rep. of Germany ..... 3507925

[51] Int. Cl.[4] ..... B41F 21/10; B41F 29/02

[52] U.S. Cl. ..... 101/409; 101/422

[58] Field of Search ..... 101/416 R, 419, 420, 101/409–412, 246, 422, 232; 271/204, 206, 82

[56] References Cited

U.S. PATENT DOCUMENTS 1,436,688 11/1922 Smith ..... 101/409

3,126,826 3/1964 Fischer ..... 101/420

4,402,267 9/1983 Demoore ..... 101/422 X

*Primary Examiner*—J. Reed Fisher

*Attorney, Agent, or Firm*—Leydig, Voit & Mayer

[57] ABSTRACT

A sheet feed drum for transferring sheets in a rotary printing press wherein the drum other contour is provided with an ink-repellent coating and two circumferentially spaced front and rear drum edges defining a duct therebetween which accommodates a sheet gripper system. The ink-repellent coating supporting a netting-like fabric relatively loosely thereon prevents any smearing of a freshly printed underside of a sheet during sheet feed on the drum while the sheet is engaged by the gripper system. Starting at the front edge of the drum, the outer contour of the drum is constructed in the form of a continuously increasing signal merging into a fixed drum radius whereby the netting-like fabric is contactable by the freshly printed underside of the sheet on the sprial first substantially flatly behind the front edge of the drum and then in any subsequent angle of rotation of the drum without the sheet tangent ever being bent or creased.

1 Claim, 3 Drawing Figures

SHEET FEED DRUM FOR ROTARY PRESSES

FIELD OF THE INVENTION

The present invention relates generally to a sheet feed drum for rotary printing presses and more particularly concerns such a drum wherein the outer contour is provided with an ink-repellent coating supporting a netting-like fabric relatively loosely thereon for preventing any smearing of a freshly printed underside of a sheet during the sheet feed.

BACKGROUND OF THE INVENTION

A sheet feed drum as described above is known from U.S. Pat. No. 4,402,267. This sheet feed drum preferably has a PTFE (Teflon) coated outer surface with a circular outer contour. However, it is a disadvantage of the sheet feed drum disclosed in this patent that with the continuously circular outer contour, the sheet bends adjacent the front edge of the drum as the drum rotates because the sheet cannot be pulled off sufficiently flatly due to other inherent design features of the system. Therefore printed sheets which must satisfy high quality requirements regularly become unusable due to the resulting marking on the freshly printed underside of the sheet.

Other sheet feed drums known heretofore with textile coverings, e.g. in accordance with EP-B No. 0 036 937, U.S. Pat. No. 3,126,826, DE-B No. 1,471,728, AT-B No. 341,550, also have a circular outer contour so that the foregoing difficulties in respect of the marking of the freshly printed underside of the sheet at the front edge of the drum occur in varying degrees depending upon the properties of the covering used and its cooperation with the drum.

OBJECTS AND SUMMARY OF THE INVENTION

The primary object of the invention is to develop a sheet feed drum for rotary presses of the type indicated hereinbefore so that, as the drum continues to rotate beneath the sheet, the netting-like fabric does not contact the freshly printed underside of the sheet at the front edge of the drum facing the gripper tip, during any angle of rotation of the sheet feed drum, even if the sheet cannot be pulled off sufficiently flatly due to other inherent design features of the system.

It is a further object of the invention that the sheet feed drum of the kind referred to above can be used universally in any sheet feed systems for printing presses and the like.

According to the present invention, a sheet feed drum for transferring sheets in a rotary printing press is provided wherein the drum outer contour is provided with an ink-repellent coating and two circumferentially spaced front and rear drum edges defining a duct therebetween which accommodates a sheet gripper system, the ink-repellent coating supports a netting-like fabric relatively loosely thereon preventing any smearing of a freshly printed underside of a sheet during sheet feed on the drum while the sheet is engaged by the gripper system. Starting at the front edge of the drum, the outer contour of the drum is constructed in the form of a continuously increasing spiral merging into a fixed drum radius whereby the netting-like fabric is contactable by the freshly printed underside of the sheet on the spiral first substantially flatly behind the front edge of the drum and then in any subsequent angle of rotation of the drum without the sheet tangent ever being bent or creased.

The main advantage of the invention is that sheets can be fed without any smearing in rotary press sheet feed systems which, in the past, due to the tangent of the sheet at the impression cylinder to the grippers taking the sheet over tends, after a certain angular position of the drum, to automatically lie first on the front edge of the drum resulting in marking and bending of the sheet. The range of application of sheet feed drums of the kind described hereinbefore is thus extended to all known sheet feed systems in multi-color sheet-fed rotary offset presses.

These and other features and advantages of the invention will be more readily apparent upon reading the following description of the preferred embodiments of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DESCRIPTION OF THE PREFERRED EMBODIMENTS

Figure 1:
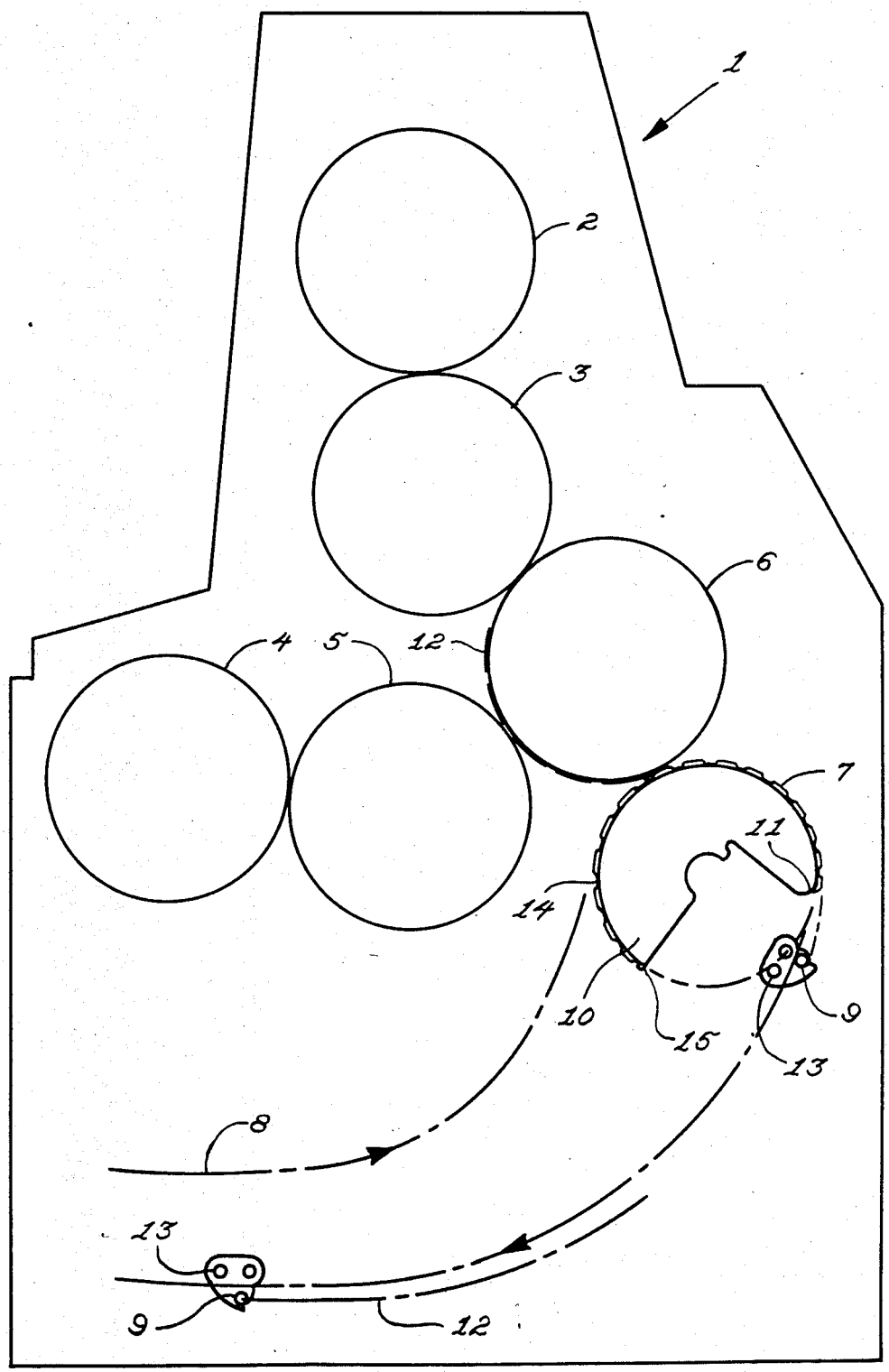
FIG. 1 is a schematic side elevation view of a multicolor sheet-fed rotary offset printing press with a 5-cylinder double printing unit and a chain conveyor trained around a sheet delivery drum constructed in accordance with the present invention.

Turning now to the drawings, there is shown in FIG. 1, a multi-color sheet-fed rotary offset press of conventional construction comprising two pairs of plate and blanket cylinders 2, 3 and 4, 5 respectively. A sheet 12 fed to the printing unit 1, for example from a sheet feeder (not shown) or a preceding similar printing unit, is carried around an impression cylinder 6, during which operation it can be provided with a two-color print. The sheet 12 is then transferred to a conveyor chain 8 via a sheet delivery drum 10. The chain 8 delivers the sheet 12 either to another printing unit (not shown) or to a sheet delivery unit.

Figure 2:
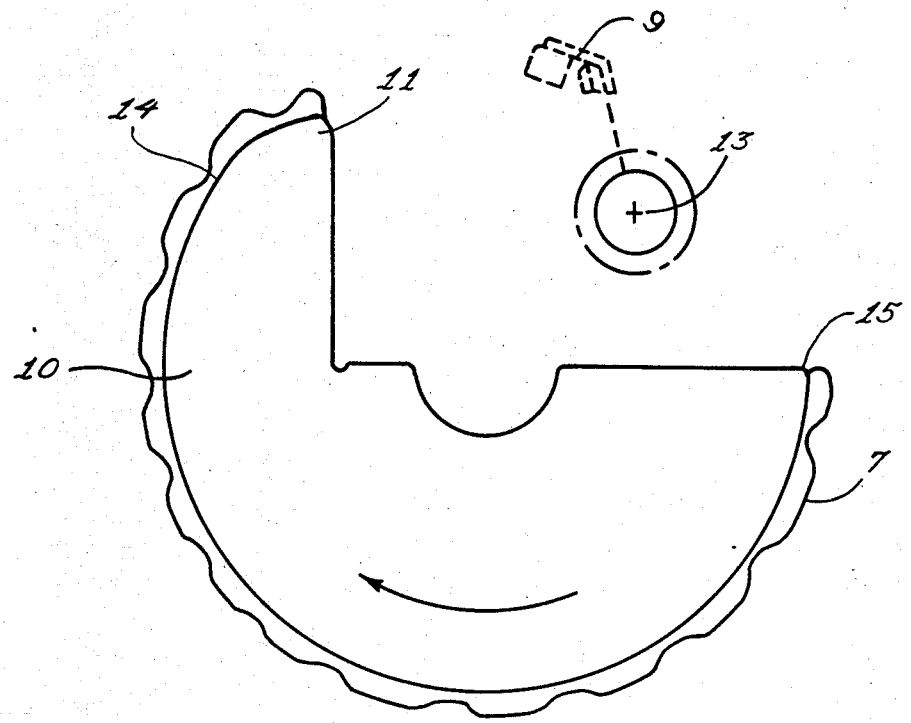
FIG. 2 is an enlarged schematic side elevation view of the sheet delivery drum shown in FIG. 1.
Figure 3:
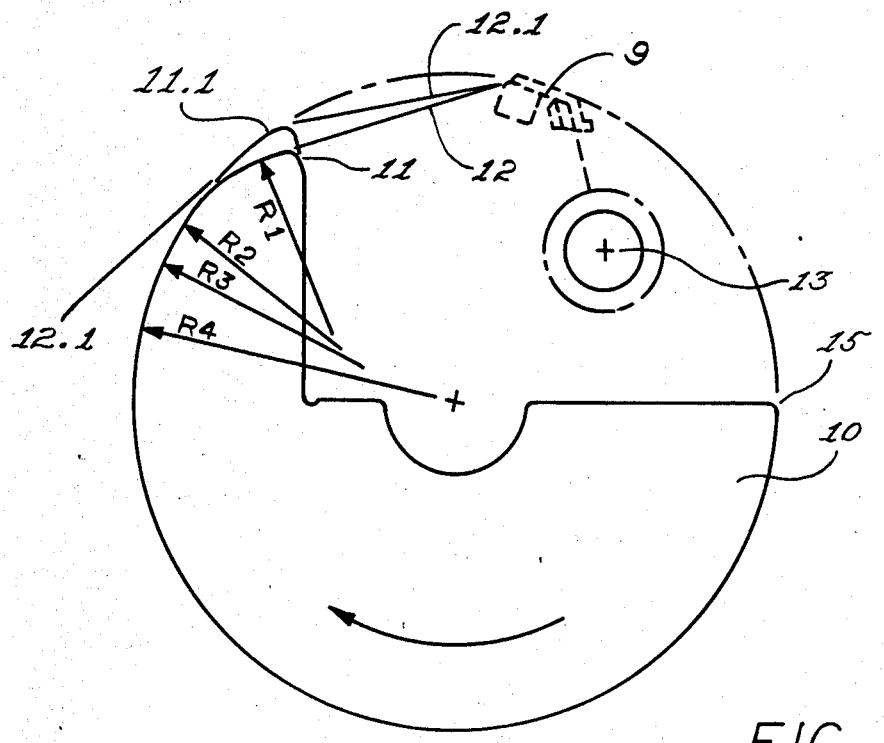
FIG. 3 is a further schematic side elevation view of the sheet delivery drum shown in FIGS. 1 and 2 and also diagrammatically illustrating the development of the spiral contour at the front edge of the drum.

Referring to FIG. 2, the sheet delivery drum 10 is provided with an ink-repellent coating 14, e.g. a PTFE (Teflon) coating. A netting-like fabric 7 is disposed relatively loosely on the outer contour of the drum 10 in order that there may always be an identical compensatory movement between the fabric 7 supporting the sheet 12 and the coating 14 of the drum 10. The outer contour of the drum 10 is bounded by front and rear edges 11 and 15 to which the fabric 7 is releasably secured. Sheet grippers 9 on the chain 8 conventionally engage the leading edge of the sheet 12 and pull it off over the front edge 11 of the drum 10. In FIGS. 2 and 3 the middle of a gripper shaft is denoted by the reference 13.

If the drum 10 had only a circular outer contour, the sheet tangent 12.1 with the freshly printed underside of the sheet 12 would bend at the front edge 11.1 shown in broken lines in FIG. 3 and mark the print, so that prints required to satisfy high quality requirements would become generally unusable. To prevent this, according to the invention, the outer contour of the drum 10 is constructed in the form of a continuously increasing spiral having the radii of curvature Rl to R3 in a fixed radius R4. As a result, in each angular position and spatial location of the drum 10, the netting-like fabric 7 first carries the freshly printed underside of the sheet 12 so that there is no bend of the sheet tangent 12.1 and the sheet is free of any marking flatly behind the front edge 11. The outer contour provided according to the invention for the drum 10 differs from the generally customary circular outer contour and allows universal use in all known sheet feed systems and rotary presses. Independently of the use and arrangement of the drum 10, the netting-like fabric 7 always first bears flatly behind the front edge 11, thus avoiding any bending of the sheet while, at the same time, the unobstructed compensatory movement of the netting-like fabric 7 on the ink-repellent coating 14 is always maintained in the region of the front edge 11 of the drum.

We claim as our invention:

1. A sheet feed drum for transferring freshly printed sheets in a rotary printing press wherein the drum outer contour is provided with an ink-repellent coating and two circumferentially spaced front and rear drum edges defining a duct therebetween which accommodates a sheet gripper system, said ink-repellent coating supporting a netting-like fabric relatively loosely thereon, said fabric preventing any smearing of a freshly printed underside of a sheet during sheet feed on the drum while the sheet is engaged by the gripper system, characterized in that starting at the front edge of the drum, the outer contour of the drum is constructed in the form of a smooth and continuously increasing spiral curve merging into a fixed drum radius whereby the netting-like fabric is contactable by the freshly printed underside of the sheet on the spiral surface first substantially flatly behind the front edge of the drum and then in any subsequent angle of rotation of the drum without the sheet tangent ever being bent or creased, which would cause smearing and distortion of the ink on the printed underside of the sheet.

* * * * *

UNITED STATES PATENT AND TRADEMARK OFFICE

CERTIFICATE OF CORRECTION

PATENT NO. : 4,690,054

DATED : September 1, 1987

INVENTOR(S) : Bert Cappel, Karl L. Knapp and Adolf Jung

It is certified that error appears in the above-identified patent and that said Letters Patent is hereby corrected as shown below:

IN THE ABSTRACT OF THE DISCLOSURE:

Line 2, change "other" to --outer--;

Line 12, change "signal" to --spiral--;

Line 15, change "sprial" to --spiral--.

Signed and Sealed this

Seventh Day of June, 1988

*Attest:*

*Attesting Officer*

DONALD J. QUIGG

*Commissioner of Patents and Trademarks*